US011424559B1

(12) United States Patent
Ruiz et al.

(10) Patent No.: US 11,424,559 B1
(45) Date of Patent: Aug. 23, 2022

(54) STRAIN RELIEF FOR BATTERY CABLE TERMINALS

(71) Applicant: GM Global Technology Operations LLC, Detroit, MI (US)

(72) Inventors: Luis J Ruiz, Metepec (MX); Francisco David Velasco, Toluca (MX)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 17/314,169

(22) Filed: May 7, 2021

(51) Int. Cl.

| | |
|---|---|
| ***H01R 4/70*** | (2006.01) |
| ***H01R 13/58*** | (2006.01) |
| *H01R 11/12* | (2006.01) |
| *H01R 4/18* | (2006.01) |

(52) U.S. Cl.
CPC ..... *H01R 4/70* (2013.01); *H01R 13/58* (2013.01); *H01R 4/183* (2013.01); *H01R 11/12* (2013.01)

(58) Field of Classification Search
CPC ..... H01R 4/70; H01R 4/183; H01R 11/12; H01R 13/58; H01R 13/585; H01R 13/5845
See application file for complete search history.

(56) References Cited

U.S. PATENT DOCUMENTS

| | | | | |
|---|---|---|---|---|
| 3,775,730 | A * | 11/1973 | Rowls | H01R 11/289 439/765 |
| 5,021,305 | A * | 6/1991 | Turner | H01R 11/284 439/522 |
| 5,486,434 | A * | 1/1996 | Aoyama | H01R 11/283 439/756 |
| 7,530,843 | B1 * | 5/2009 | Tesfay | H01R 13/521 439/587 |
| 8,246,369 | B2 * | 8/2012 | Okayasu | H02G 15/04 174/92 |
| 9,083,108 | B2 * | 7/2015 | Adachi | H01R 13/521 |
| 10,819,063 | B1 * | 10/2020 | Myong | H02G 15/1806 |
| 2021/0348685 | A1 * | 11/2021 | Lord | F16J 15/025 |

FOREIGN PATENT DOCUMENTS

| | | | | |
|---|---|---|---|---|
| WO | WO-2013183305 | A1 * | 12/2013 | H01R 13/506 |

* cited by examiner

*Primary Examiner* — Travis S Chambers
(74) *Attorney, Agent, or Firm* — Vivacqua Crane, PLLC

(57) ABSTRACT

An automotive battery cable includes an electrical wire, a terminal crimped onto a distal end of the electrical wire, and a sleeve positioned on the electrical wire and extending over an attachment point between the terminal and the electrical wire, the sleeve including a first portion including a body and a neck, the body including an inner surface having contour features adapted to allow the body to deform and compress against the attachment point and matching the shape of the attachment point to sealingly encapsulate the attachment point, and the neck extending from the body around and along the electrical wire, and a second portion encircling and compressing the body onto the attachment point to seal the attachment point within the first portion and to provide a positive stop to limit relative motion of the electrical wire and the terminal at the attachment point.

20 Claims, 3 Drawing Sheets

STRAIN RELIEF FOR BATTERY CABLE TERMINALS

INTRODUCTION

The present disclosure relates to an automotive battery cable, and more particularly, to a sleeve for a ring terminal of an automotive battery cable adapted to buffer relative motion between the cable and an attached terminal.

In automotive applications, battery cables are used to connect a battery and electrical grounds within the automobile to the electrical system of the automobile. Typically, these battery cables include a terminal that is crimped onto the battery cable. The terminal is secured to the positive and negative terminals on the battery or structural elements of the automobile or powertrain, as the case may be.

A typical battery cable and terminal are shown. Once the terminal is secured to the battery, motion of the battery cable relative to the terminal causes a sharp bend in the electrical wire of the battery cable at the point of connection to the terminal. Over time, repeated bending of the electrical wire of the battery cable will fatigue the electrical wire and cause failure of the electrical wire at the point of connection to the terminal.

The electrical wire of the battery cable is typically coated in a plastic insulation material, however, to facilitate connection to the terminal, a distal end of the electrical wire must be bare. Exposure to external elements, such as moisture, can cause corrosion of the electrical wire at the point of connection to the terminal, leading to failure of the electrical wire.

On solution to these problems has been to install a heat shrink sleeve onto the battery cable over the point of connection to the terminal. The heat shrink sleeve provides some strain relief by buffering relative motion between the battery cable and the terminal at the point of connection, and provides some sealing against external contaminants, however, adding a heat shrink sleeve is cumbersome, time consuming and costly.

Thus, while current automotive battery cables achieve their intended purpose, there is a need for a new and improved automotive battery cable that provides strain relief to buffer relative motion between the electrical wire and the terminal at the point of connection and seals the point of connection from external contamination.

SUMMARY

According to several aspects of the present disclosure, and automotive battery cable includes an electrical wire, a ring terminal crimped onto a distal end of the electrical wire, and a sleeve positioned on the electrical wire and extending over an attachment point between the terminal and the electrical wire, the sleeve including a first portion made from a soft elastomeric material and adapted to buffer relative motion of the electrical wire and the terminal, the first portion including a body and a neck, the body including an inner surface having contour features adapted to allow the body to deform and compress against the attachment point and matching the shape of the attachment point to sealingly encapsulate the attachment point between the electrical wire and the terminal and prevent any external contamination from contacting the attachment point, and the neck extending from the body around and along the electrical wire, and a second portion made from a rigid material and encircling the body of the first portion and compressing the body onto the attachment point to seal the attachment point within the first portion and to provide a positive stop to limit relative motion of the electrical wire and the terminal at the attachment point.

According to another aspect, the second portion includes a first half and a second half, the first and second halves being connected by an integrally formed hinge portion adapted to allow the second portion to be opened and closed, the first half including features adapted to engage corresponding features of the second half to secure the second portion in a closed position when placed onto the first portion of the sleeve, the second portion including a first opening and a second opening when in the closed position, wherein portions of the terminal extend from the attachment point through the first opening and out from the sleeve, and the neck of the first portion and the electrical wire extend from the attachment point through the second opening and out from the second portion.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
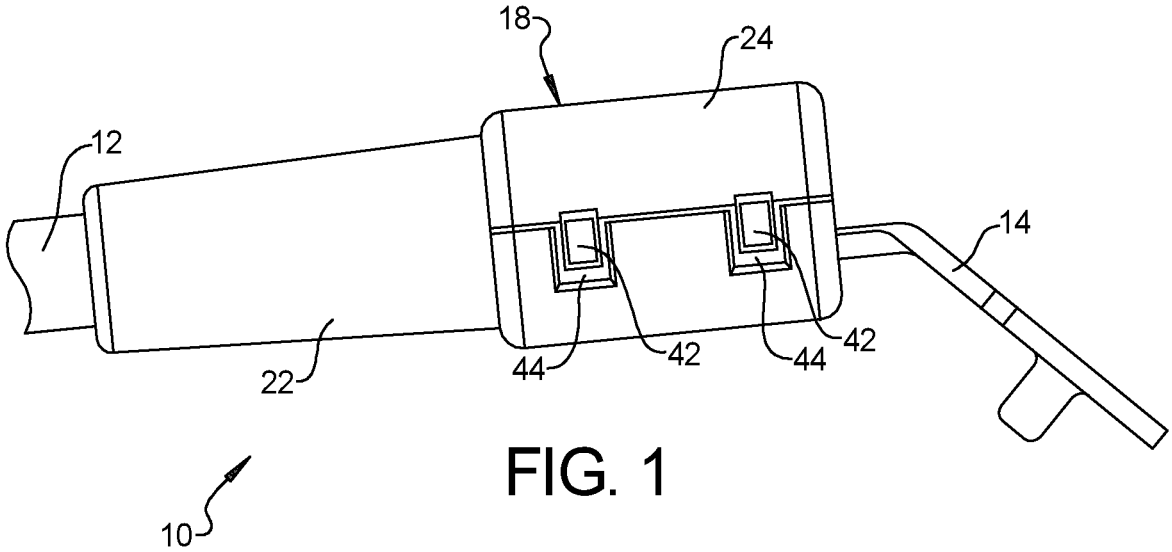
FIG. 1 is a perspective view of a battery cable according to an exemplary embodiment.
Figure 2:
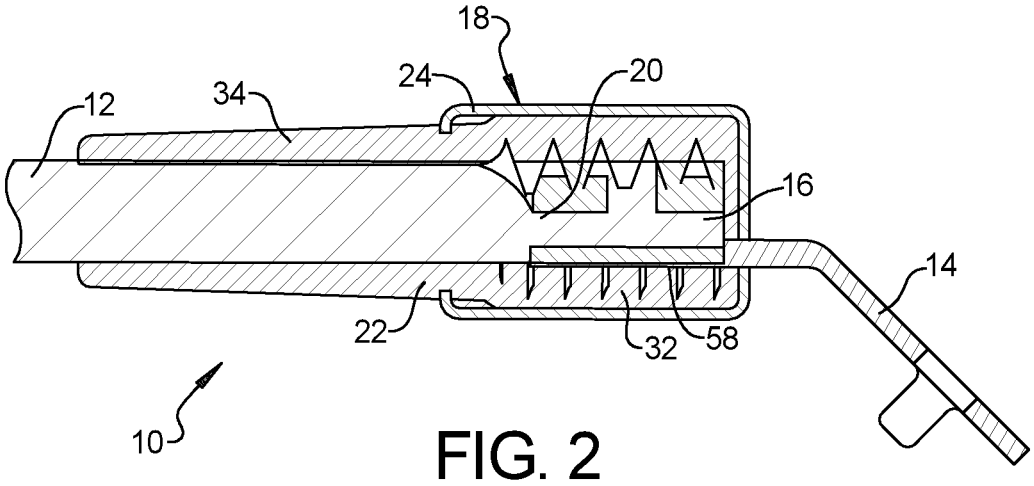
FIG. 2 is a sectional view of the battery cable shown in FIG. 1.

Referring to FIG. 1 and FIG. 2, an automotive battery cable 10 in accordance with the present disclosure includes an electrical wire 12, a terminal 14 attached to a distal end 16 of the electrical wire 12, and a sleeve 18 positioned on the electrical wire 12 and extending over an attachment point 20 between the terminal 14 and the electrical wire 12. The sleeve 18 includes a first portion 22 that is adapted to buffer relative motion of the electrical wire 12 and the terminal 14 at the attachment point 20. The sleeve 18 further includes a second portion 24 compressing the first portion 22 onto the attachment point 20 to seal the attachment point 20 within the first portion 22 and to provide a positive stop to limit relative motion of the electrical wire 12 and the terminal 14 at the attachment point 20.

Figure 3A:
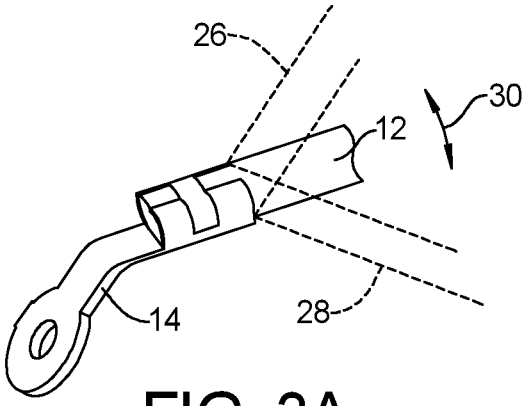
FIG. 3A is a perspective view of a battery cable with a terminal crimped onto a distal end of the battery cable.

Referring to FIG. 3A, in an exemplary embodiment, the terminal 14 is a ring terminal that is crimped onto the bare distal end 16 of the electrical wire 12. When placed onto a battery within an automobile, the terminal 14 will be placed onto a post of a battery and secured thereto, such as by a threaded wingnut, or a clamp. Once attached to the post, the terminal 14 is held in place, however the electrical wire 12 will be free to move relative to the terminal 14. During normal operation of the automobile, the electrical wire 12 may move back and forth between extreme positions 26, 28 as indicated by arrows 30. Motion of the electrical wire 12 relative to the terminal 14, either side to side or up and down, in this way can result in a sharp bend in the electrical wire 12 at the attachment point 20 between the electrical wire 12 and the terminal 14. Over time, repeated bending of the electrical wire 12 will fatigue the electrical wire 12 and cause failure of the electrical wire 12 at the attachment point 20 to the terminal 14.

Figure 3B:
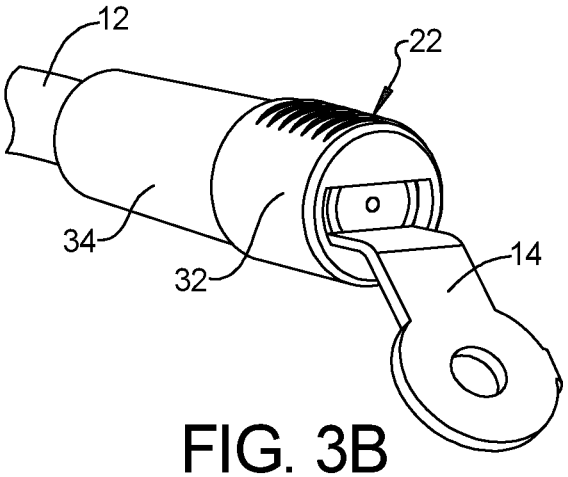
FIG. 3B is a perspective view of the battery cable shown in FIG. 3A with a first portion of a sleeve positioned thereon.

Referring to FIG. 3B, the battery cable 10 is shown with the first portion 22 of the sleeve 18 placed onto the electric wire 12. The first portion 22 includes a body 32 and a neck 34. The body 32 sealingly encapsulates the attachment point 20 between the electrical wire 12 and the terminal 14 to prevent any external contamination from contacting the attachment point 20. The neck 34 extends from the body 32 around and along the electrical wire 12.

The first portion 22 is made from a soft elastomeric material. In one exemplary embodiment, the first portion 22 is thermoformed onto the electrical wire 12 and the attachment point 20. In another exemplary embodiment, the first portion 22 is pre-formed and stretched over the electrical wire 12 and the attachment point 20. The electrical wire 12 of the battery cable 10 is typically coated in a plastic insulation material, however, to facilitate connection to the terminal 14, the distal end 16 of the electrical wire 12 must be bare. Exposure to external elements, such as moisture, can cause corrosion of the electrical wire 12 at the attachment point 20 to the terminal 14, leading to failure of the electrical wire 12. The soft elastomeric material of the first portion 22 easy conforms to the shape of the attachment point 20 to sealingly encapsulate the attachment point 20, preventing exposure of the attachment point 20 to contamination.

Figure 3C:
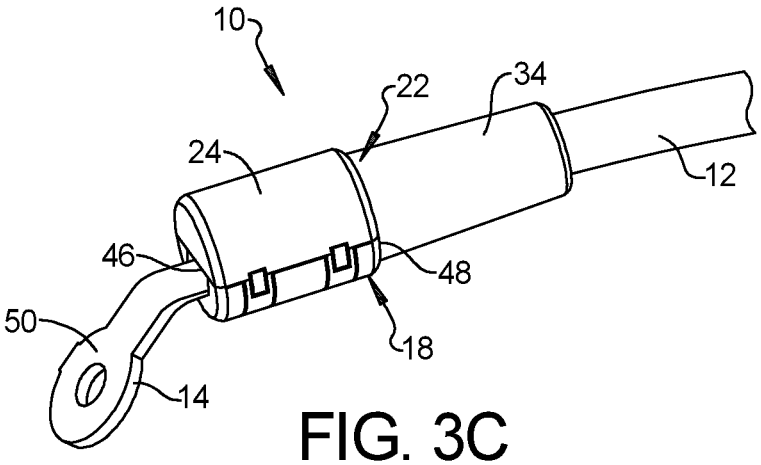
FIG. 3C is a perspective view of the battery cable shown in FIG. 3B with a second portion of a sleeve positioned thereon.

Referring to FIG. 3C, the battery cable 10 is shown with the second portion 24 of the sleeve 18 placed onto the first portion 22 of the sleeve 18. The second portion 24 of the sleeve 18 is made from a rigid material. In an exemplary embodiment, the second portion is made from hard plastic. The second portion 24 encircles the body 32 of the first portion 22 and compresses the body 32 onto the attachment point 20.

Figure 4:
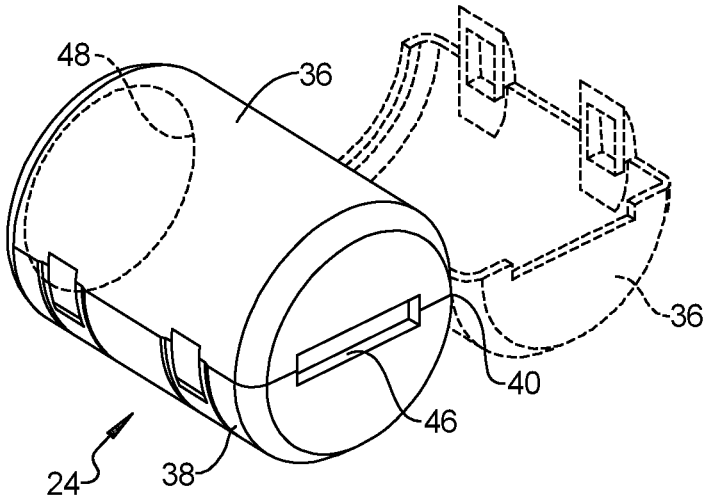
FIG. 4 is a perspective view of the second portion of the sleeve shown in a closed position, and an open position in shadow.

Referring to FIG. 4, the second portion 24 includes a first half 36 and a second half 38. The first and second halves 36, 38 are connected by an integrally formed hinge 40. The hinge 40 allows the first half 36 of the second portion 24 to be moved relative to the second half 38 of the second portion 24 between a closed position, as shown in FIG. 4, and an open position, shown in shadow in FIG. 4.

The first half 36 of the second portion 24 includes features 42 adapted to engage corresponding features 44 of the second half 38 to secure the second portion 24 in the closed position when placed onto the first portion 22 of the sleeve 18. As shown, the features 42 of the first half 36 and the features 44 of the second half 38 comprise a latch that removably holds the second portion 24 in the closed position. When in the closed position, the second portion 24 includes a first opening 46 and a second opening 48. The first and second openings 46, 48 are positioned at opposite ends of the second portion 24 of the sleeve 18.

When the first and second portions 22, 24 of the sleeve 18 are placed onto the electrical wire 12 and the attachment point 20 to the terminal 14, a ring portion 50 of the terminal 14 extends from the attachment point 20 through the first opening 46 and out from the sleeve 18. Likewise, when the first and second portions 22, 24 of the sleeve 18 are placed onto the electrical wire 12 and the attachment point 20 to the terminal 14, the neck 34 of the first portion 22 and the electrical wire 12 extend from the attachment point 20 through the second opening 48 and out from the second portion 24 of the sleeve 18.

Figure 5:
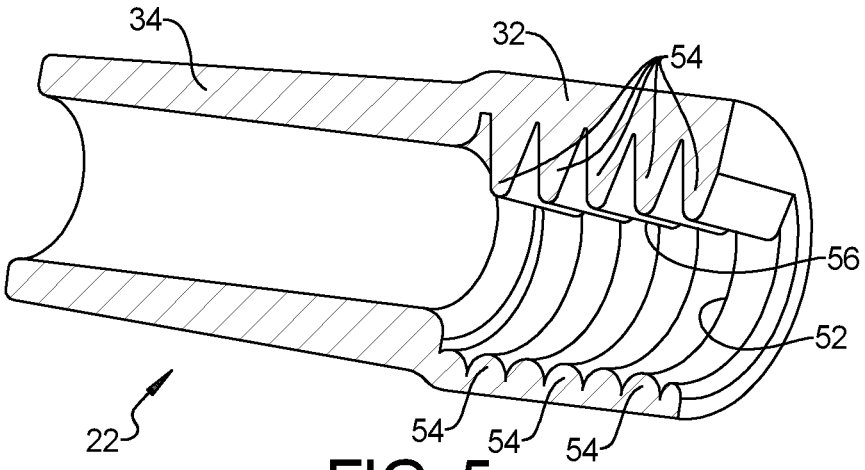
FIG. 5 is a sectional view of the first portion of the sleeve.

Referring to FIG. 5, in an exemplary embodiment, the body 32 includes an inner surface 52 including contour features 54. The contour features 54 are adapted to allow the inner surface 52 of the body 32 to deform and compress against the attachment point 20 to seal the attachment point 20 from external contamination. As shown, the contour features 54 comprise ridges extending circumferentially around the inner surface 52 of the body 32. The contour features 54 are able to contort and deform more easily than a smooth inner surface, thereby allowing the inner surface 52 to deform and compress to more closely conform to the shape of the attachment point 20 between the electrical wire 12 and the terminal 14, and thus, to better seal the attachment point 20 from external contamination.

In still another exemplary embodiment, the contour features 54 match the shape of the attachment point 20 to seal the attachment point 20 from external contamination. Referring again to FIG. 5, the contour features 54 formed within the inner surface 52 of the body 32 include a portion 56 adapted to match the shape of the attachment point 20 between the electrical wire 12 and the terminal 14. As shown, the contour features 54 include a portion 56 that extends inward and defines a flat profile that matches a back side 58 of the terminal 14 at the attachment point 20. The shape matching contour features 54 are able to deform and compress to more closely conform to the shape of the attachment point 20 between the electrical wire 12 and the terminal 14, and thus, to better seal the attachment point 20 from external contamination.

A battery cable 10 and sleeve 18 of the present disclosure offers several advantages. First, the first portion 22 of the sleeve 18 will absorb energy when the electrical wire 12 is flexed relative to the terminal 14. This absorption of energy by the neck 34 of the first portion 22 will dampen the relative motion, and help to prevent sharp bending of the electrical wire 12 at the attachment point 20. Further, the soft pliable first portion 22 will absorb vibration and small relative motion. Finally, the soft first portion 22 of the sleeve 18 will sealingly engage the attachment point 20 to prevent contamination and thus corrosion of the bare wire at the attachment point 20. The second portion 24 of the sleeve 18 enhances this benefit by compressing the body 32 of the first portion 22 onto the attachment point 20 to better seal the attachment point 20 within the body 32 of the first portion 22. Finally, the second portion 24 also provides a hard stop to prevent too much relative motion between the electrical wire 12 and the terminal 14. The first portion 22 slows and dampens flexing of the electrical wire 12 relative to the terminal 14, and helps to prevent sharp bending of the electrical wire 12 at the attachment point 20. The hard second portion 24 provides a hard stop to prevent any further relative motion of the electrical wire 12 and the terminal 14.

The sleeve 18 of the present disclosure is easily added to a battery cable 10 to cover the attachment point 20 between the electrical wire 12 and the terminal 14. Further, the second portion 24 of the sleeve 18 removably compresses the body 32 of the first portion 22 with no need to utilize a heat shrink process to seal the attachment point 20 from external corrosion.

The description of the present disclosure is merely exemplary in nature and variations that do not depart from the gist of the present disclosure are intended to be within the scope of the present disclosure. Such variations are not to be regarded as a departure from the spirit and scope of the present disclosure.

What is claimed is:

1. An automotive battery cable, comprising:

an electrical wire;

a terminal attached to a distal end of the electrical wire; and a sleeve positioned on the electrical wire and extending over an attachment point between the terminal and the electrical wire, the sleeve including:

a first portion adapted to buffer relative motion of the electrical wire and the terminal at the attachment point; and a second portion compressing the first portion onto the attachment point to seal the attachment point within the first portion and to provide a positive stop to limit relative motion of the electrical wire and the terminal at the attachment point.

2. The battery cable of claim 1, wherein the terminal is crimped onto the distal end of the electrical wire.

3. The battery cable of claim 2, wherein the terminal is a ring terminal.

4. The battery cable of claim 2, wherein the first portion includes a body and a neck, the body sealingly encapsulating the attachment point between the electrical wire and the terminal to prevent any external contamination from contacting the attachment point, and the neck extending from the body around and along the electrical wire.

5. The battery cable of claim 4, wherein the first portion is made from a soft elastomeric material.

6. The battery cable of claim 5, wherein the second portion is made from a rigid material and encircles the body of the first portion and compresses the body onto the attachment point.

7. The battery cable of claim 6, wherein the second portion includes a first half and a second half, the first and second halves being connected by an integrally formed hinge adapted to allow the second portion to be opened and closed, the first half including features adapted to engage corresponding features of the second half to secure the second portion in a closed position when placed onto the first portion of the sleeve, the second portion including a first opening when in the closed position, wherein portions of the terminal extend from the attachment point through the first opening and out from the sleeve, and a second opening when in the closed position, wherein the neck of the first portion and the electrical wire extend from the attachment point through the second opening and out from the second portion.

8. The battery cable of claim 6, wherein the first portion is thermoformed onto the electrical wire and the attachment point.

9. The battery cable of claim 6, wherein the first portion is stretched over the electrical wire and the attachment point.

10. The battery cable of claim 9, wherein the body includes an inner surface including contour features adapted to allow the inner surface of the body to deform and compress against the attachment point to seal the attachment point from external contamination.

11. The battery cable of claim 10, wherein the contour features match the shape of the attachment point to seal the attachment point from external contamination.

12. A sleeve for an automotive battery cable terminal, comprising:

a first portion adapted to buffer relative motion of an electrical wire and a terminal at an attachment point between the electrical wire and the terminal; and a second portion adapted to compress the first portion onto the attachment point to seal the attachment point within the first portion and to provide a positive stop to limit relative motion of the electrical wire and the terminal at the attachment point.

13. The sleeve of claim 12, wherein the first portion includes a body and a neck, the body adapted to sealingly encapsulate the attachment point between the electrical wire and the terminal to prevent any external contamination from contacting the attachment point, and the neck adapted to extend from the body around and along the electrical wire.

14. The sleeve of claim 13, wherein the first portion is made from a soft elastomeric material.

15. The sleeve of claim 14, wherein the second portion is made from a rigid material and encircles the body of the first portion and compresses the body onto the attachment point.

16. The sleeve of claim 15, wherein the second portion includes a first half and a second half, the first and second halves being connected by an integrally formed hinge adapted to allow the second portion to be opened and closed, the first half including features adapted to engage corresponding features of the second half to secure the second portion in a closed position when placed onto the first portion of the sleeve, the second portion including a first opening and a second opening when in the closed position, wherein portions of the terminal extend from the attachment point through the first opening and out from the sleeve, and the neck of the first portion and the electrical wire extend from the attachment point through the second opening and out from the second portion when the sleeve is placed onto a battery cable.

17. The sleeve of claim 15, wherein the body includes an inner surface including contour features adapted to allow the body to deform and compress against the attachment point to seal the attachment point from external contamination.

18. The sleeve of claim 17, wherein the contour features match the shape of the attachment point to seal the attachment point from external contamination.

19. An automotive battery cable, comprising:

an electrical wire;

a ring terminal crimped onto a distal end of the electrical wire; and a sleeve positioned on the electrical wire and extending over an attachment point between the terminal and the electrical wire, the sleeve including:

a first portion made from a soft elastomeric material and adapted to buffer relative motion of the electrical wire and the terminal at the attachment point, the first portion including a body and a neck, the body including an inner surface having contour features adapted to allow the body to deform and compress against the attachment point and matching the shape of the attachment point to sealingly encapsulate the attachment point between the electrical wire and the terminal and prevent any external contamination from contacting the attachment point, and the neck extending from the body around and along the electrical wire; and a second portion made from a rigid material and encircling the body of the first portion and compressing the body onto the attachment point to seal the attachment point within the first portion and to provide a positive stop to limit relative motion of the electrical wire and the terminal at the attachment point.

20. The battery cable of claim 19, wherein the second portion includes a first half and a second half, the first and second halves being connected by an integrally formed hinge adapted to allow the second portion to be opened and closed, the first half including features adapted to engage corresponding features of the second half to secure the second portion in a closed position when placed onto the first portion of the sleeve, the second portion including a first opening and a second opening when in the closed position, wherein portions of the terminal extend from the attachment point through the first opening and out from the sleeve, and the neck of the first portion and the electrical wire extend from the attachment point through the second opening and out from the second portion.

* * * * *